US011359432B2

(12) United States Patent
Wang

(10) Patent No.: US 11,359,432 B2
(45) Date of Patent: Jun. 14, 2022

(54) SAFETY GATE

(71) Applicant: Demby Development Co., Ltd., New Taipei (TW)

(72) Inventor: Tsung-Hsiang Wang, New Taipei (TW)

(73) Assignee: DEMBY DEVELOPMENT CO., LTD., New Taipei (TW)

( * ) Notice: Subject to any disclaimer, the term of this patent is extended or adjusted under 35 U.S.C. 154(b) by 105 days.

(21) Appl. No.: 16/940,582

(22) Filed: Jul. 28, 2020

(65) Prior Publication Data

US 2021/0040791 A1 Feb. 11, 2021

(30) Foreign Application Priority Data

Aug. 7, 2019 (CN) ..... 201921273905.0

(51) Int. Cl.
*E06B 9/72* (2006.01)
*E06B 9/08* (2006.01)
*E06B 9/00* (2006.01)

(52) U.S. Cl.
CPC ..... *E06B 9/08* (2013.01); *E06B 2009/002* (2013.01)

(58) Field of Classification Search
CPC ..... E06B 9/60; E06B 2009/543; E06B 9/56; E06B 2009/002; E06B 9/90; E06B 2009/801; E06B 9/80; E06B 9/08
See application file for complete search history.

(56) References Cited

U.S. PATENT DOCUMENTS 9,598,896 B1 * 3/2017 Pichik ..... E06B 9/13
2008/0121354 A1 * 5/2008 Cheng ..... E06B 9/80 160/290.1
2008/0190572 A1 * 8/2008 Kwak ..... E06B 9/42 160/313
2010/0307700 A1 * 12/2010 Wang ..... E06B 9/40 160/264
2011/0088323 A1 * 4/2011 Lundh ..... E06B 9/08 49/57
2013/0299101 A1 * 11/2013 Wang ..... E06B 9/13 160/303
2014/0000819 A1 * 1/2014 Mullet ..... E06B 9/60 160/311
2014/0196371 A1 * 7/2014 Lundh ..... E05B 17/10 49/13
2015/0376942 A1 * 12/2015 Henderson ..... E06B 9/08 160/133
2016/0281423 A1 * 9/2016 Kao ..... E06B 9/42
(Continued)

*Primary Examiner* — Daniel P Cahn
*Assistant Examiner* — Matthew R. Shepherd
(74) *Attorney, Agent, or Firm* — Bradley J. Thorson; DeWitt LLP

(57) ABSTRACT

A safety gate has a first post assembly, a spinning mechanism, a cover body, and a positioning mechanism. The spinning mechanism is rotatably mounted in the first post assembly. The cover body has an edge mounted in the spinning mechanism. The gate body is wound around and is pulled out from the spinning mechanism to spin the spinning mechanism. The positioning mechanism has a knob and a positioning mount. The positioning mount is moved upwardly or downwardly relative to the spinning mechanism to selectively disengage from and engage with the spinning mechanism. The spinning mechanism is prevented from spinning while being engaged with the positioning mount.

7 Claims, 11 Drawing Sheets

(56) References Cited

U.S. PATENT DOCUMENTS

| | | | | |
|---|---|---|---|---|
| 2018/0044982 | A1* | 2/2018 | Wang | E06B 9/08 |
| 2018/0080278 | A1* | 3/2018 | Huang | E06B 9/60 |
| 2019/0078382 | A1* | 3/2019 | Wang | E06B 9/13 |

* cited by examiner

SAFETY GATE

BACKGROUND OF THE INVENTION

1. Field of the Invention

The present invention relates to a safety gate.

2. Description of the Prior Arts

A conventional safety gate is mounted at an entrance of a building or an area for controlling access to the building or area. Operational steps of the conventional safety gate for detaching the safety gate for a user to walk through the entrance are inconvenient. When the conventional safety gate is not in use, the storage of the conventional safety gate is inconvenient due to large storage spaces, which is inconvenient for the user.

To overcome the shortcomings, the present invention provides a safety gate to mitigate or obviate the aforementioned problems.

SUMMARY OF THE INVENTION

The main objective of the present invention is to provide a safety gate that is easy to assemble and disassemble and a user can walk through an entrance of the safety gate conveniently.

The safety gate has a first post assembly, a spinning mechanism, a cover body, and a positioning mechanism. The spinning mechanism is rotatably mounted in the first post assembly and has a first abutting portion. The cover body has two edges, and one of the edges is mounted in the spinning mechanism. The cover body is selectively wound around the spinning mechanism, and is selectively pulled out from the spinning mechanism to spin the spinning mechanism. The positioning mechanism has a knob having a lug and a positioning mount connected with the knob. The positioning mount is moved upwardly or downwardly relative to the spinning mechanism to selectively disengage from and engage with the spinning mechanism, and has a sliding groove having a second abutting portion protruding from the sliding groove. The lug is slidably mounted in the sliding groove and selectively abuts against the second abutting portion.

When the positioning mount is engaged with the spinning mechanism to prevent the spinning mechanism from spinning, the lug is located below and abuts against the first abutting portion to prevent the positioning mechanism from moving up relative to the spinning mechanism. When the lug is slid to misalign with the first abutting portion and abuts against the second abutting portion, the positioning mount is capable of moving up relative to the spinning mechanism to disengage from the spinning mechanism.

Other objectives, advantages and novel features of the invention will become more apparent from the following detailed description when taken in conjunction with the accompanying drawings.

DETAILED DESCRIPTION OF THE PREFERRED EMBODIMENTS

It should be noted that when a component is referred to as being "fixed" to another component, it can be directly mounted on said another component or still another component may be disposed between the component and said another component. When a component is considered to be "connected" to another component, it can be directly connected to said another component or still another component may be disposed between the component and said another component. The terms "vertical," "horizontal," "left," "right," and the like, as used herein, are for the purpose of illustration and are not intended to be the only embodiment.

All technical and scientific terms used herein have the same meaning as commonly understood by one of ordinary skill in the art to the invention. The terminology used in the description of the present invention is for the purpose of describing particular embodiments and is not intended to limit the invention. The term "and/or" used herein includes any and all combinations of one or more of the associated listed items.

Figure 1:
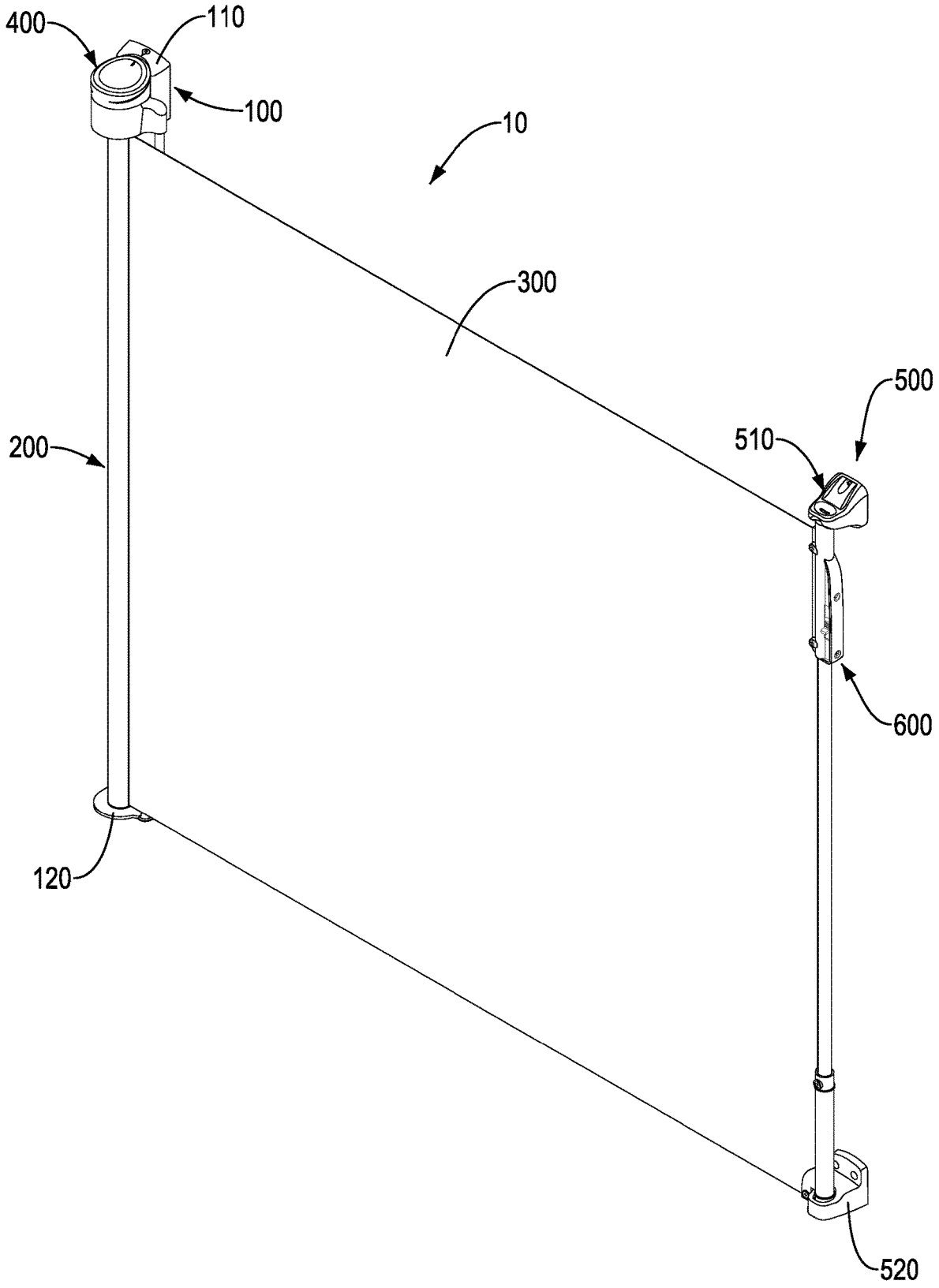
FIG. 1 is a perspective view of a safety gate in accordance with the present invention.

With reference to FIG. 1, a safety gate 10 in accordance with the present invention is adapted to block an entrance. The safety gate 10 has a first post assembly 100, a spinning mechanism 200, a cover body 300, and a positioning mechanism 400. The first post assembly 100 is mounted on a side of the entrance. When the safety gate 10 is not in use, the cover body 300 is wound around the spinning mechanism 200. When the safety gate 10 is used to block the entrance, the cover body 300 is pulled out from the spinning mechanism 200 and is fixed on the other side of the entrance to block the entrance.

Figure 2:
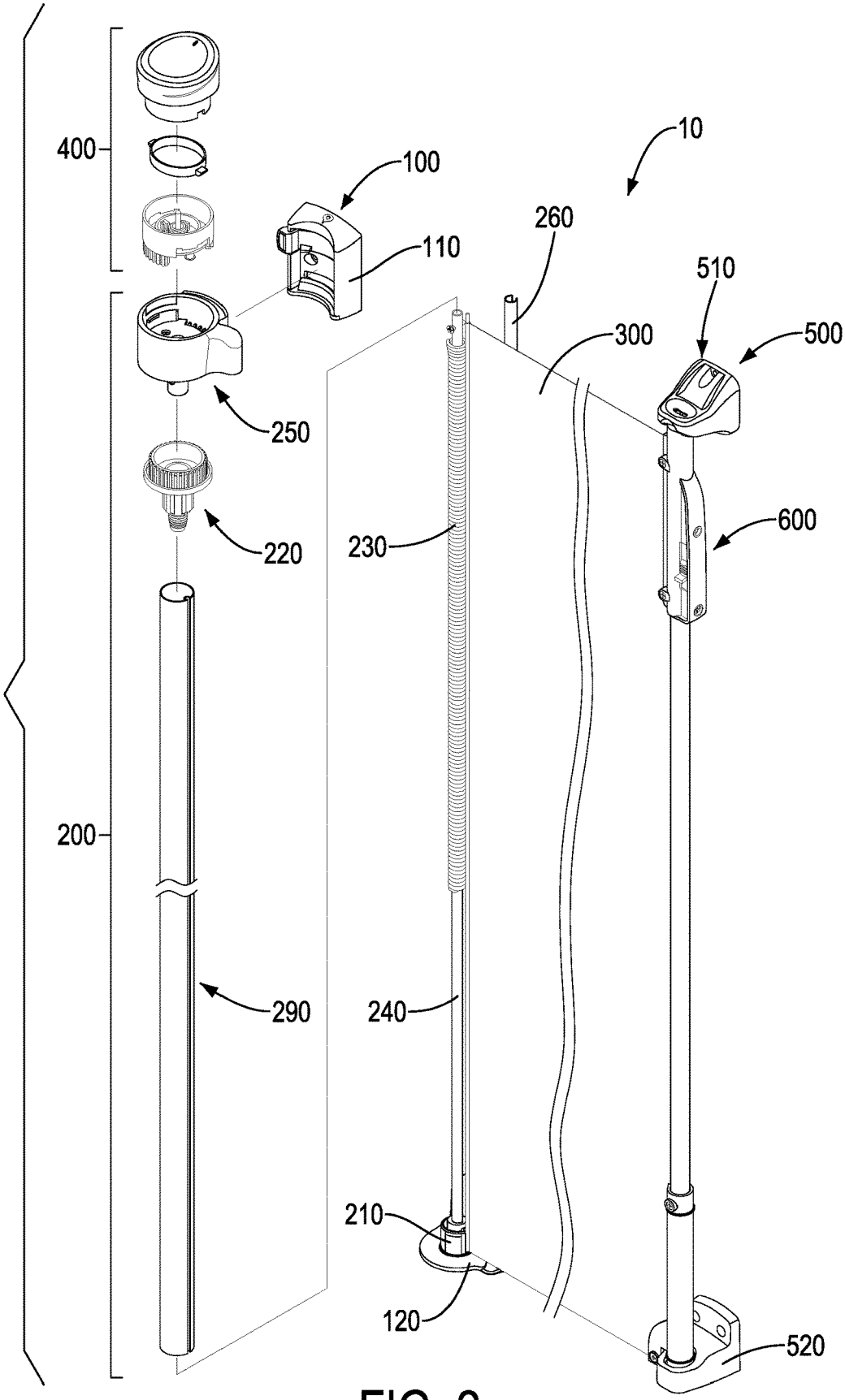
FIG. 2 is an exploded perspective view of the safety gate in FIG. 1.
Figure 3:
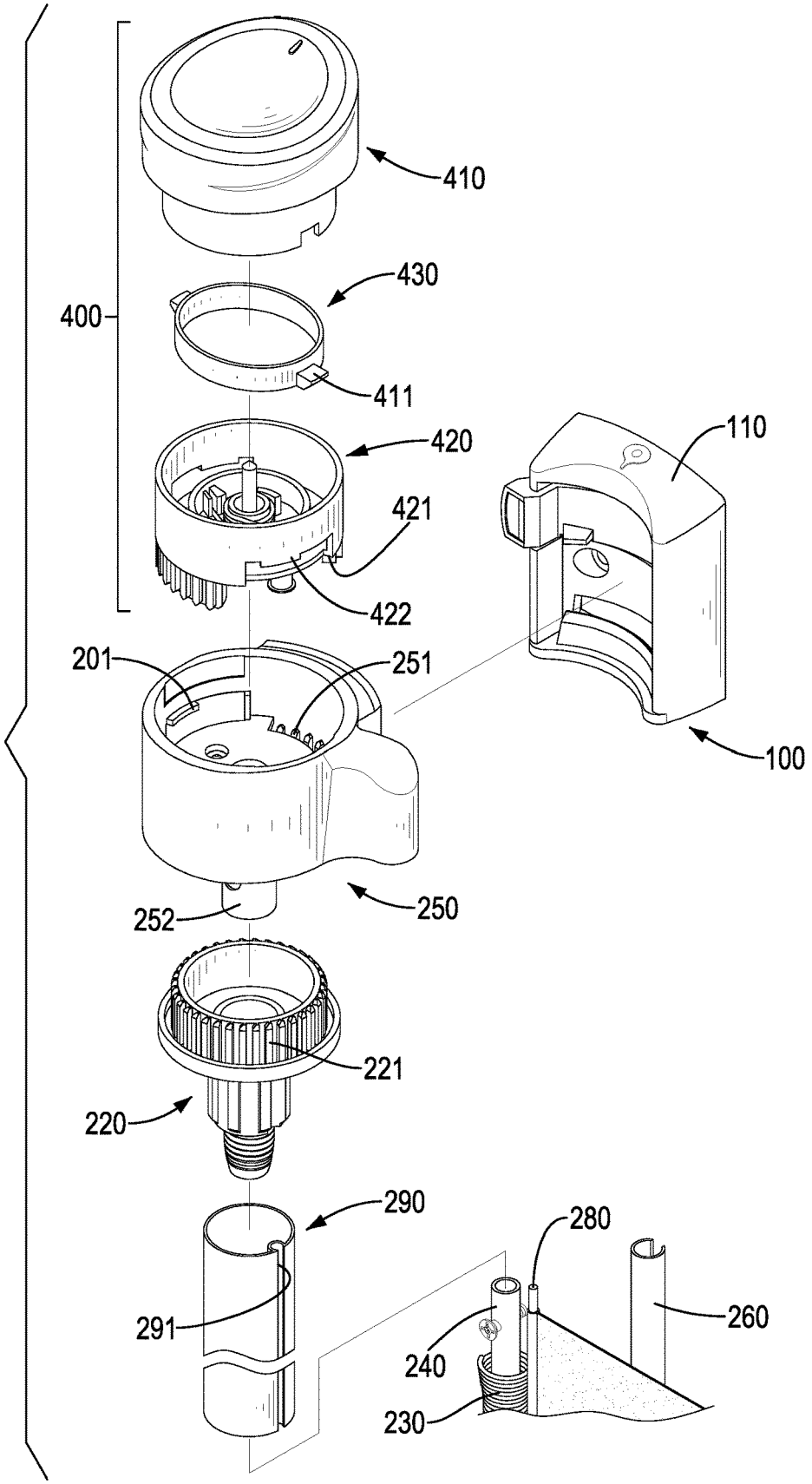
FIG. 3 is an enlarged and exploded perspective view of the safety gate in FIG. 2.

With reference to FIGS. 2 and 3, the spinning mechanism 200 is rotatably mounted in the first post assembly 100. A left edge of the cover body 300 is mounted in the spinning mechanism 200. The cover body 300 is pulled out to spin the spinning mechanism 200 relative to the first post assembly 100 and to release the cover body 300 from winding around the spinning mechanism 200. The positioning mechanism 400 has a knob 410 and a positioning mount 420. The knob 410 is connected with the positioning mount 420, and the knob 410 can be turned relative to the positioning mount 420. The positioning mount 420 is moved upwardly or downwardly relative to the spinning mechanism 200 to disengage from or engage with the spinning mechanism 200.

During engaging with the positioning mount 420, the spinning mechanism 200 is prevented from spinning. Specifically, the knob 410 has a lug 411 transversely protruding from an outer surface of the knob 410. The positioning mount 420 has a sliding groove 421 formed in the positioning mount 420. The lug 411 is mounted in and engaged with the sliding groove 421. The spinning mechanism 200 has a first abutting portion 201. When the first abutting portion 201 is located above and abuts against the lug 411, a vertical movement of the positioning mechanism 400 can be limited.

Figure 10:
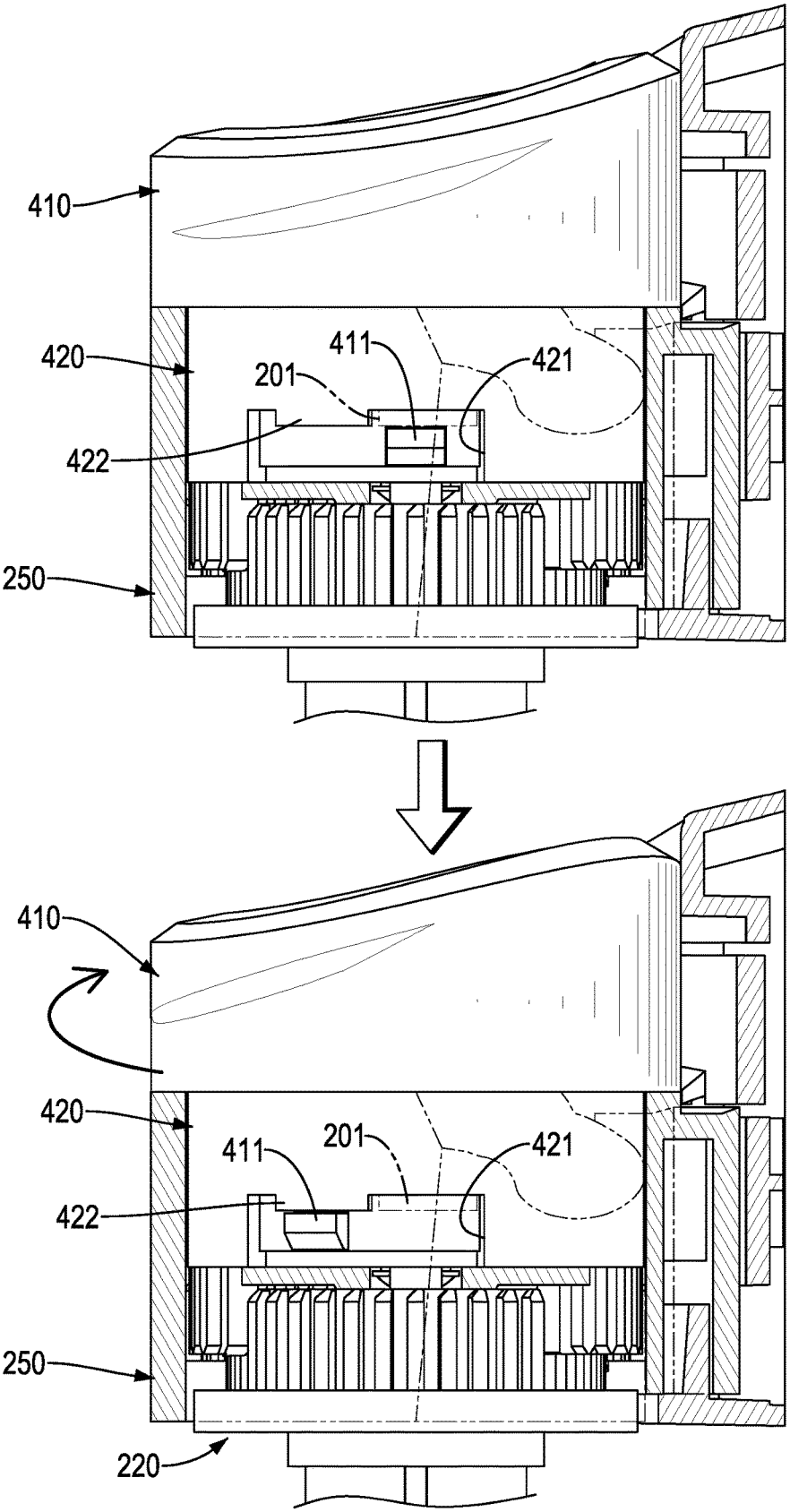
FIG. 10 shows operational enlarged side views in partial section of the safety gate in FIG. 1.

Specifically, a second abutting portion 422 is formed in the sliding groove 421, and protrudes from a top surface of the sliding groove 421. With reference to FIG. 10, the knob 410 is turned relative to the positioning mount 420 to slide the lug 411 along the sliding groove 421, the lug 411 is slid to a position below the second abutting portion 422, and the top of the lug 411 abuts against the second abutting portion 422. After the lug 411 abuts against the second abutting portion 422, the positioning mount 420 can be moved up relative to the spinning mechanism 200 by pulling up the knob 410. With reference to FIGS. 2 and 10, after the positioning mount 420 is moved up to disengage from the spinning mechanism 200, the spinning mechanism 200 can be rotated relative to the first post assembly 100 without being limited by the positioning mechanism 400.

At this time, the cover body 300 can be pulled to spin the spinning mechanism 200 relative to the first post assembly 100 to release the cover body 300 from winding on the spinning mechanism 200. Thus, the right edge of the cover body 300 can be pulled out to fix on another side of the entrance. The cover body 300 can be fixed thereto by magnetic attraction, adhesion, or hooking. The cover body 300 may be made of fabrics or plastics.

When a user wants to pass through the entrance, the cover body 300 can be wound around the spinning mechanism 200 to store the cover body 300. Storage of the cover body 300 is convenient with smaller storage spaces. To block the entrance, the cover body 300 is pulled out and is fixed on the other side of the entrance. The operation of the safety gate 10 is easy and convenient. In addition, during spinning of the spinning mechanism 200 by pulling out the cover body 300, the knob 410 will not rotate with the spinning mechanism 200 to prevent the knob 410 from damage.

Figure 4:
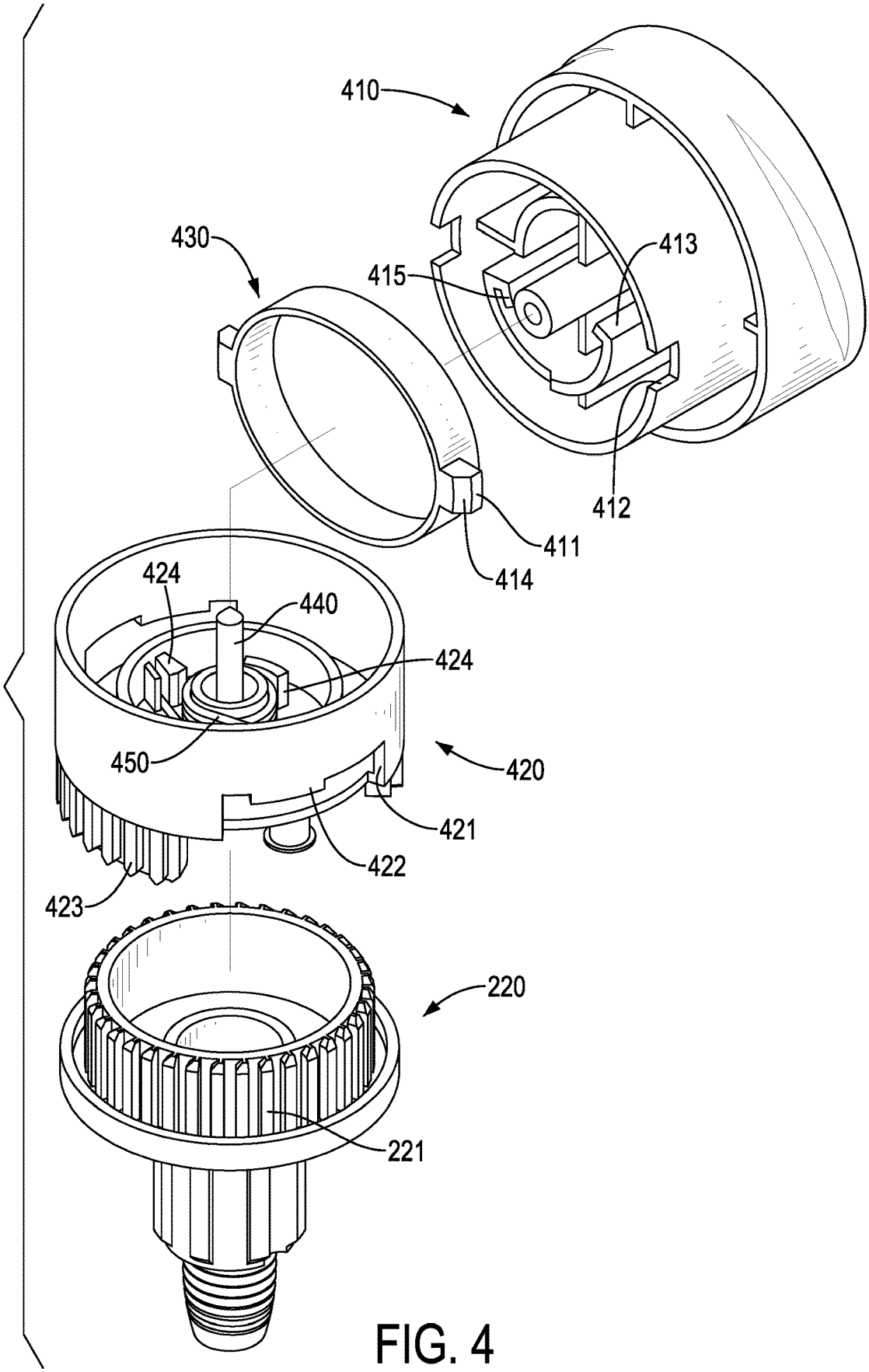
FIG. 4 is an enlarged and exploded perspective view of the safety gate in FIG. 3.
Figure 5:
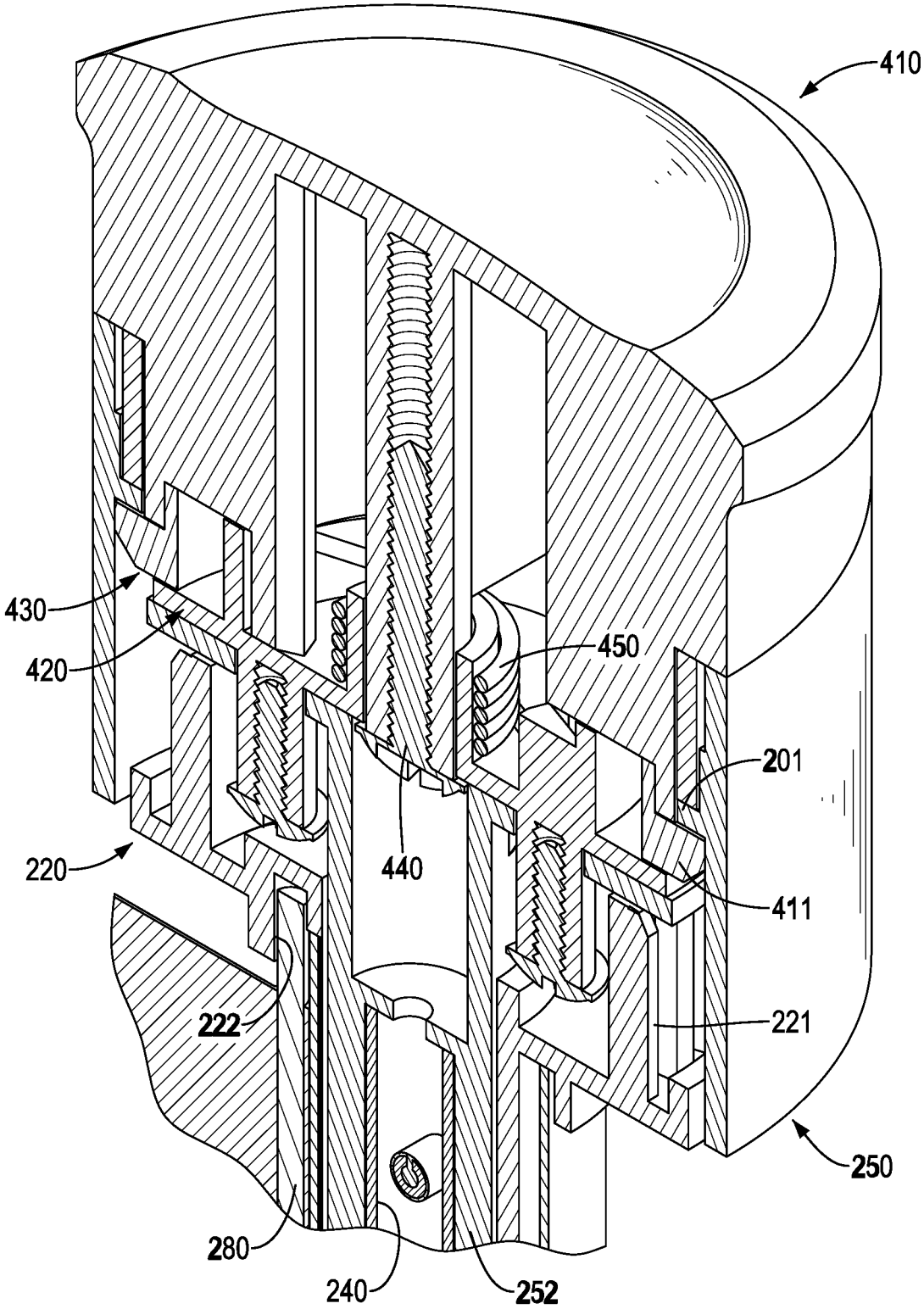
FIG. 5 is an enlarged cross sectional perspective view of the safety gate in FIG. 1.

With reference to FIGS. 2 to 4, the spinning mechanism 200 has a spinning sleeve 210, a spinning bracket 220, a first resilient element 230, a fixed rod 240, and a fixed sleeve 250. The first post assembly 100 has an upper first bracket 110 and a lower first bracket 120 arranged vertically at a spaced interval. The fixed sleeve 250 is fixed on the upper first bracket 110 by screws. Each of the lower first bracket 120 and the fixed sleeve 250 has a respective mounting hole formed therein, and a post 260 has two ends respectively mounted in the mounting holes of the lower first bracket 120 and the fixed sleeve 250 to enhance stability of the first post assembly 100. The spinning sleeve 210 is rotatably mounted on the lower first bracket 120. The spinning bracket 220 is connected with the fixed rod 240 by the first resilient element 230. The spinning bracket 220 is mounted in the fixed sleeve 250. The fixed sleeve 250 surrounds the spinning bracket 220. The spinning bracket 220 has a through hole, and the fixed sleeve 250 has a connecting sleeve 252 extending from the bottom thereof. With reference to FIG. 5, the connecting sleeve 252 is mounted through the through hole of the spinning bracket 220 and is securely connected to the fixed rod 240 by screws.

Figure 6:
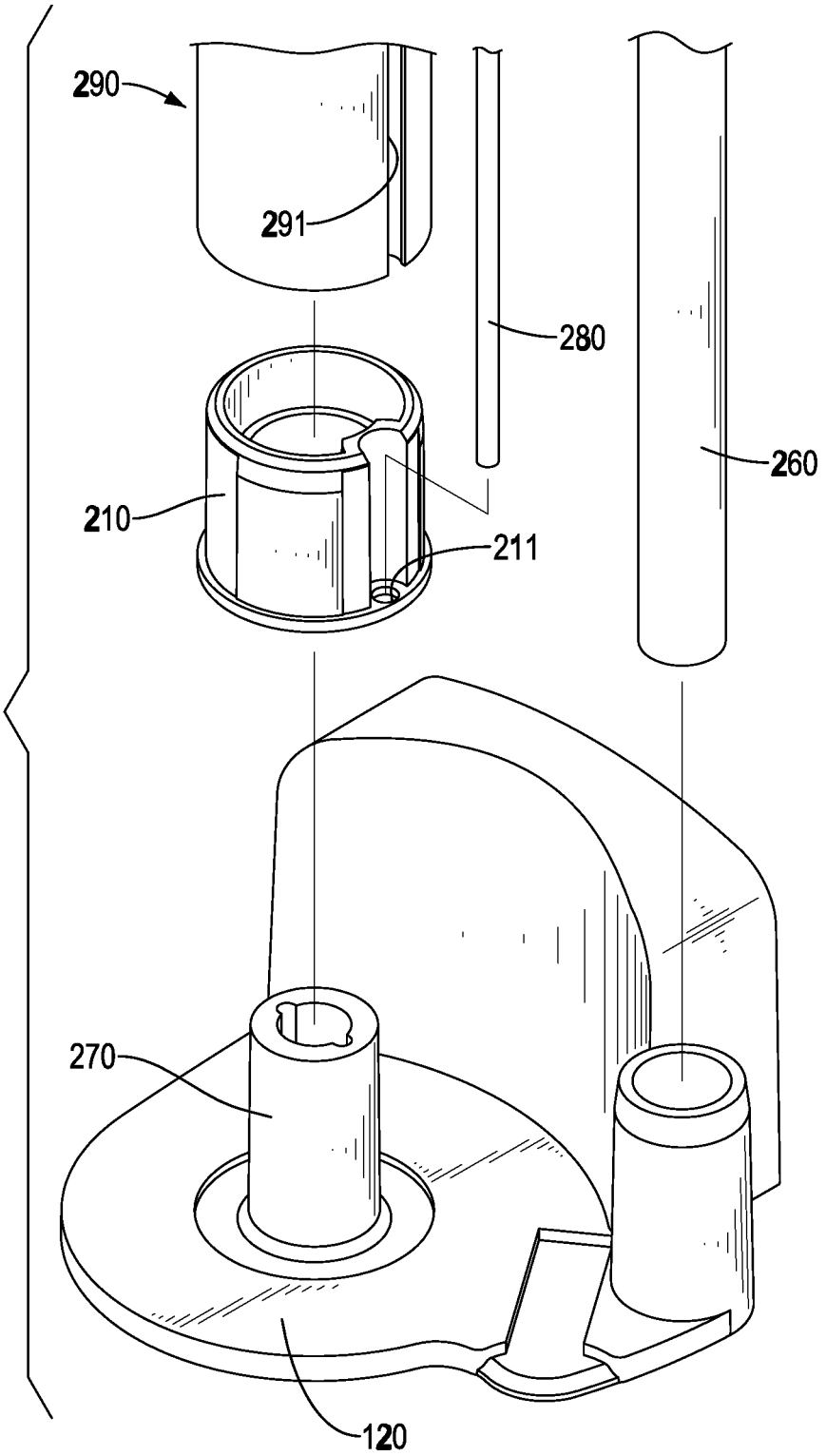
FIG. 6 is an enlarged and exploded perspective view of the safety gate in FIG. 1.

With reference to FIGS. 3 and 6, the lower first bracket 120 has a bottom mount 270. The spinning sleeve 210 surrounds the bottom mount 270. The bottom end of the fixed rod 240 is fixed in the bottom mount 270. The fixed rod 240 is used for mounting and guiding the first resilient element 230. The fixed rod 240 has a hooking opening formed therein for connecting the first resilient element 230. The first resilient element 230 surrounds the fixed rod 240. An end of the first resilient element 230 is connected with the fixed rod 240 and another end of the first resilient element 230 is connected to the spinning bracket 220. When rotating the spinning bracket 220 relative to the fixed rod 240, the first resilient element 230 is twisted to store elastic potential energy.

After the cover body 300 is removed from the side of the entrance opposite to the first post assembly 100, the first resilient element 230 will drive the spinning bracket 220 to spin. Because the cover body 300 is connected with the spinning sleeve 210 and the spinning bracket 220, the spinning bracket 220 and the spinning sleeve 210 are spinning simultaneously, and the cover body 300 is wound around the spinning sleeve 210 and the spinning bracket 220 to store the cover body 300. The cover body 300 can be stored conveniently and quickly.

With reference to FIGS. 3 and 4, the spinning bracket 220 has multiple first engagement teeth 221 formed on the outer surface thereof. The fixed sleeve 250 has multiple second engagement teeth 251 formed on the inner surface thereof. The positioning mount 420 is mounted between the fixed sleeve 250 and the spinning bracket 220 and is annular. The positioning mount 420 has multiple third engagement teeth 423 formed thereon. The third engagement teeth 423 are engaged with the first engagement teeth 221 and the second engagement teeth 251 to prevent the spinning bracket 220 from spinning. Thus, the cover body 300 can be positioned to avoid loosening after being pulled out to a fixed position.

With reference to FIGS. 4 and 5, the positioning mechanism 400 has a turning member 430 and a fastener 440. The knob 410 has an engaging recess 412 recessed in the outer surface of the knob 410. The lug 411 is formed on the turning member 430, and protrudes from and is engaged with the engaging recess 412 of the knob 410. The turning member 430 is connected with the knob 410 via an engagement between the lug 411 and the engaging recess 412. With reference to FIG. 5, the positioning mount 420 is mounted around the bottom end of the knob 410 and is connected with the knob 410 by the fastener 440. Thus, the turning member 430, the positioning mount 420, and the knob 410 are connected with each other.

Figure 9:
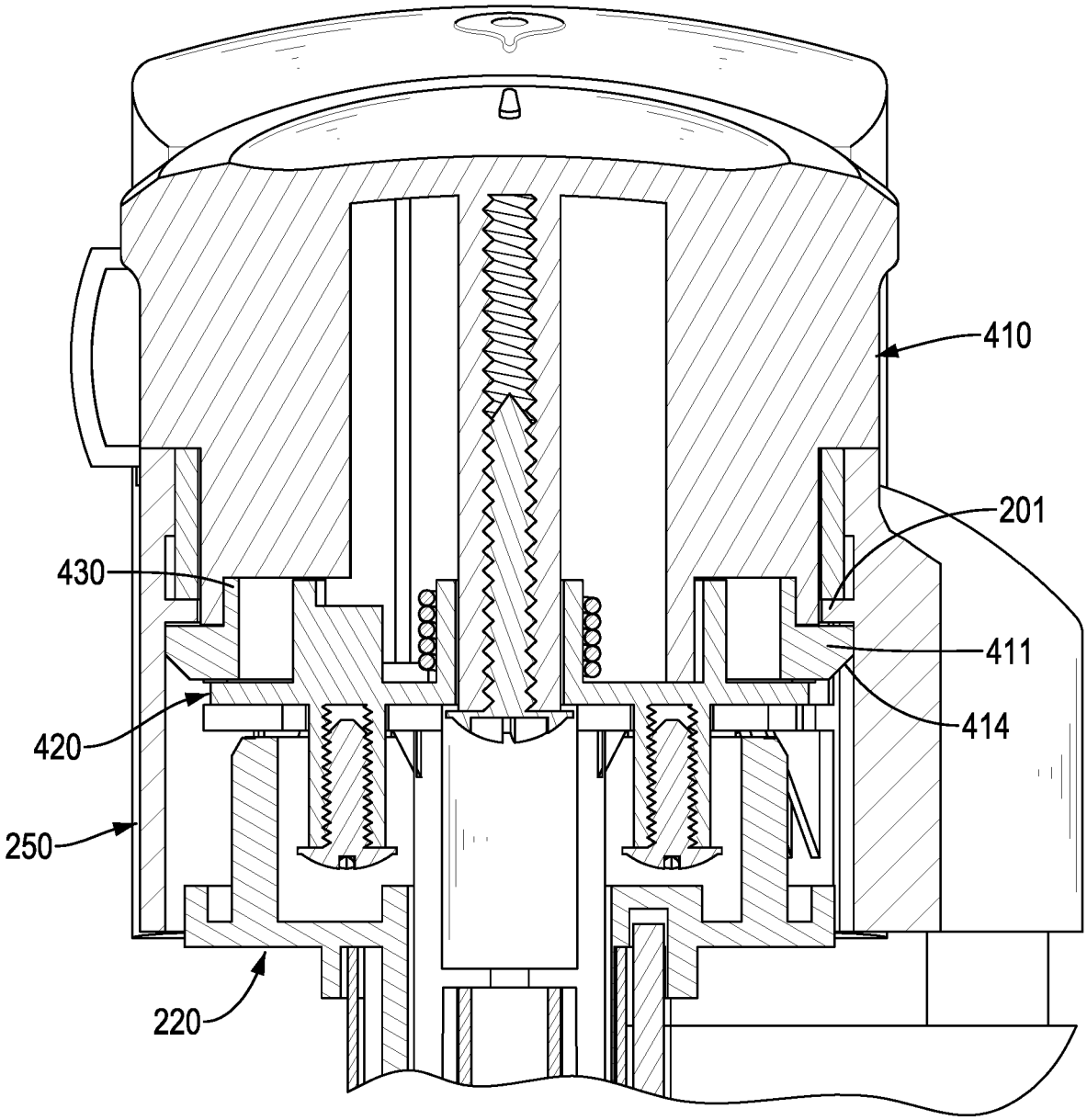
FIG. 9 is an enlarged cross sectional side view of the safety gate in FIG. 1 showing a lug located below a first abutting portion of the safety gate.
Figure 11:
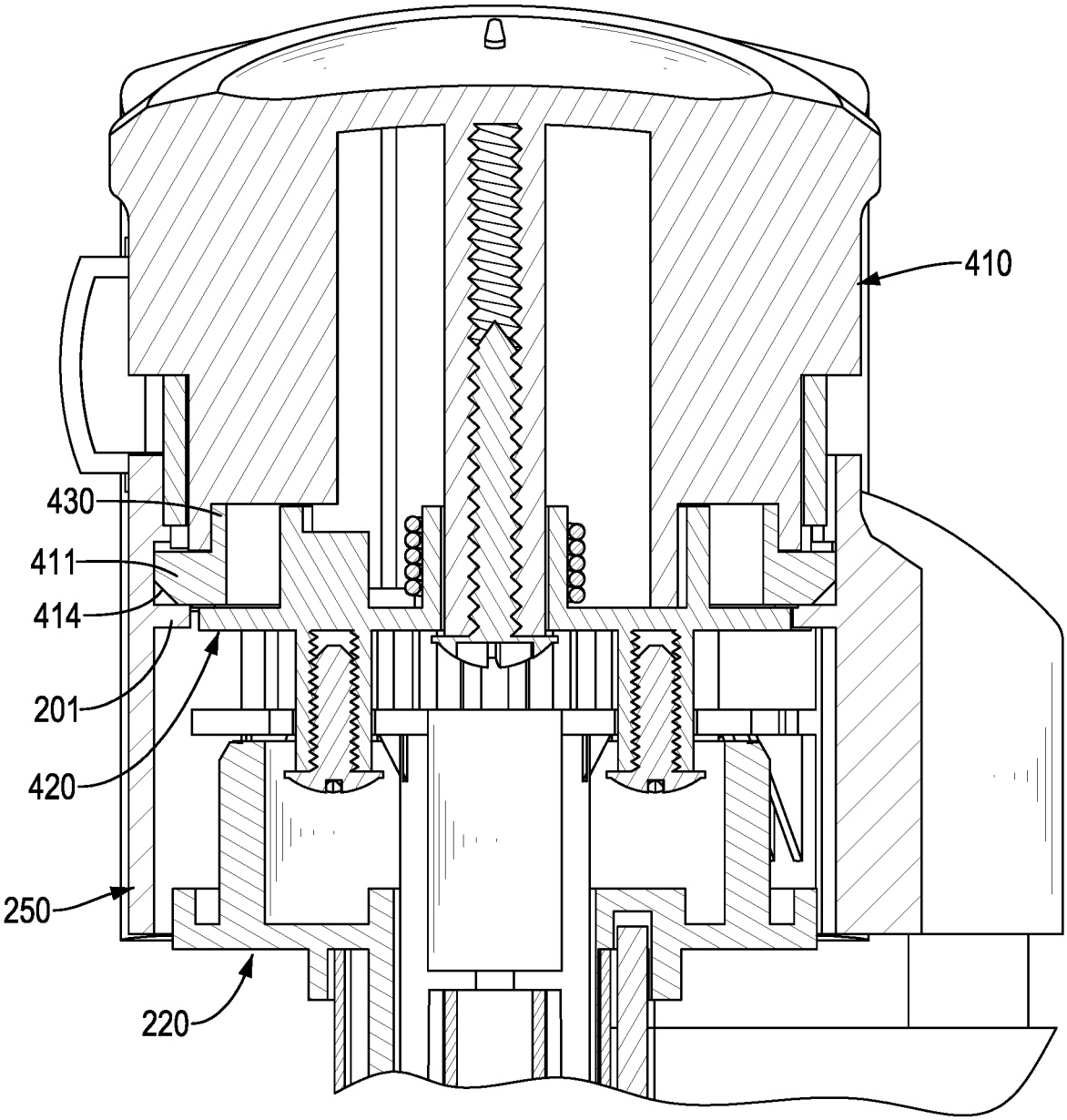
FIG. 11 is an enlarged cross sectional side view of the safety gate in FIG. 1 showing the lug located above the first abutting portion.

With reference to FIG. 9, when the positioning mount 420 locks the spinning mechanism 200, the lug 411 is located below the first abutting portion 201 and abuts against the first abutting portion 201. In the locked condition, because the first abutting portion 201 blocks the top of the lug 411, the lug 411 cannot move up while pulling the knob 410. Thus, the positioning mount 420 is locked in position. With reference to FIGS. 10 and 11, to unlock the positioning mount 420, the knob 410 is turned in a clockwise direction to slide the lug 411 along the sliding groove 421 to misalign the lug 411 from the first abutting portion 201. At this time, the positioning mount 420 can be pulled up relative to the fixed sleeve 250. When the lug 411 is slid to align with the second abutting portion 422 by turning the knob 410, the top of the lug 411 abuts the second abutting portion 422, and the lug 411 is closely engaged with the positioning mount 420 to directly pull up the positioning mount 420 relative to the fixed sleeve 250 by pulling the knob 410.

After the positioning mount 420 is disengaged from the spinning bracket 220, the knob 410 is turned in a counterclockwise direction to slide the lug 411 to a position above the first abutting portion 201 and the bottom of the lug 411 is held on the first abutting portion 201. Because the lug 411 is held by the first abutting portion 201, the positioning mount 420 will not drop down, and the positioning mount 420 can stay in an unlocked condition. The positioning mount 420 can be locked again reversely by the above operational steps. Thus, the knob 410 may not be detached from the spinning mechanism 200 to prevent the knob 410 from reinstallation and loss.

Figure 8:
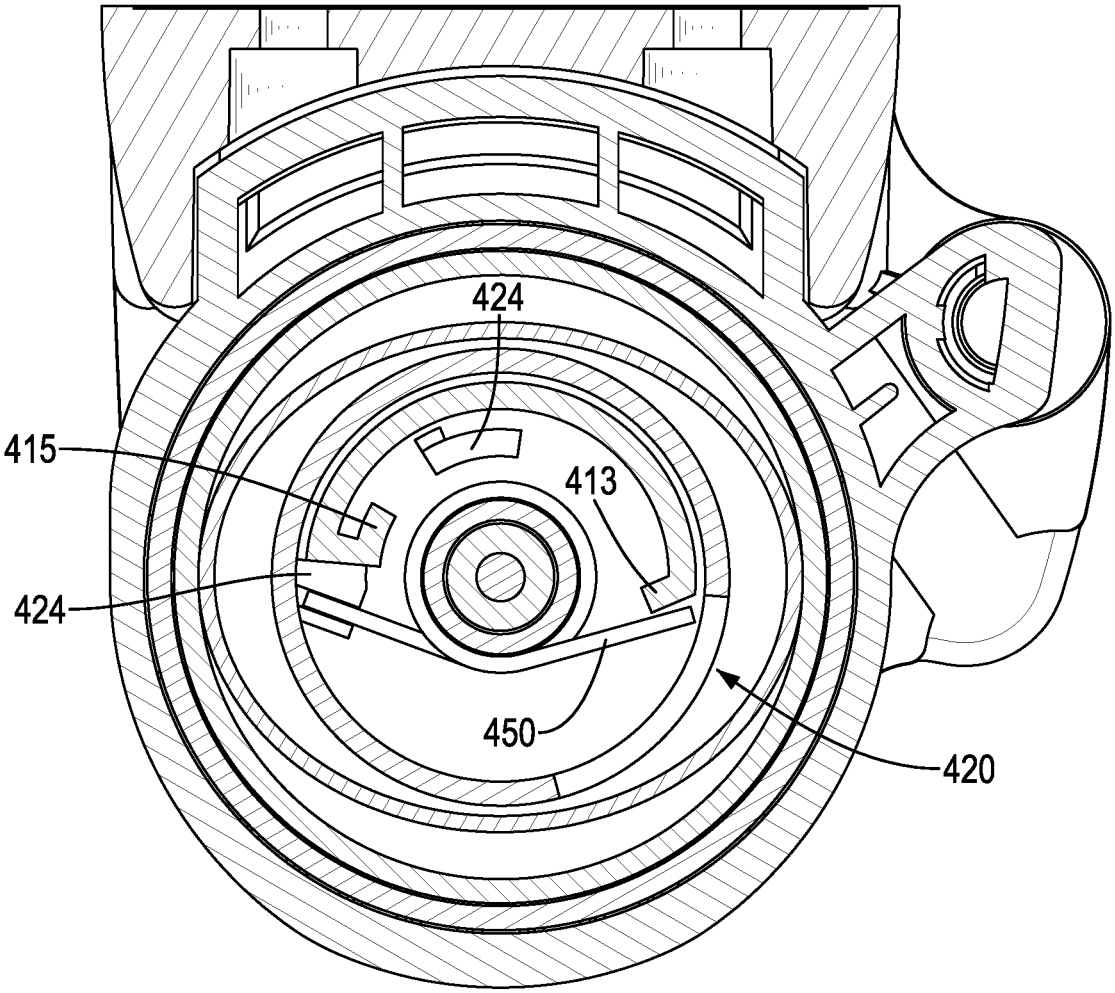
FIG. 8 is an enlarged cross sectional end view of a positioning mechanism of the safety gate in FIG. 1.

With reference to FIGS. 4, 5, and 8, the positioning mechanism 400 further comprises a torsion spring 450. The torsion spring 450 is mounted in the positioning mount 420 at a side of the positioning mount 420 that faces the knob 410. The knob 410 has a spring-abutting portion 413 near an end of the torsion spring 450. The end of the torsion spring 450 abuts against the spring-abutting portion 413. When the lug 411 is sliding along the sliding groove 421 to abut against the second abutting portion 422, the torsion spring 450 is twisted. After the positioning mount 420 is disengaged from the spinning bracket 220, the torsion spring 450 will push the spring-abutting portion 413 relative to the positioning mount 420 to drive the lug 411 to slide relative to the sliding groove 421 to align with the first abutting portion 201. Thus, after the positioning mount 420 is disengaged from the spinning bracket 220, the lug 411 can automatically slide back to a position above the first abutting portion 201 by the elastic restoring force of the torsion spring 450 to enhance operational convenience.

Preferably, the positioning mount 420 has two limiting portions 424 arranged at a spaced interval. The knob 410 has a positioning protrusion 415 formed on the end thereof facing the positioning mount 420. The positioning protrusion 415 is located between the two limiting portions 424. When the knob 410 is turned relative to the positioning mount 420 to drive the positioning protrusion 415 to abut against the two limiting portions 424, the lug 411 is slid to align with the first abutting portion 201 and the second abutting portion 422.

Preferably, with reference to FIGS. 4 and 11, the lug 411 has a beveled surface 414 formed in the bottom thereof. When the positioning mount 420 is disengaged from the spinning bracket 220 and is located above the first abutting portion 201, the beveled surface 414 faces the first abutting portion 201. Pressing the knob 410, the beveled surface 414 is slid along the first abutting portion 201, and the lug 411 is moved down to a position below the first abutting portion 201 easily by guidance of the beveled surface 414. Thus, the positioning mount 420 can be back to the locked condition from the unlocked condition by pressing the knob 410 without reversing the knob 410 to misalign the lug 411 and the first abutting portion 201 for moving down the knob 410 and the positioning mount 420. The operational convenience can be further enhanced.

With reference to FIGS. 5 and 6, the spinning bracket 220 has a first mounting hole 222, and the spinning sleeve 210 has a second mounting hole 211. The spinning mechanism 200 further comprises a mounting rod 280. Two ends of the mounting rod 280 are respectively mounted in the first mounting hole 222 and the second mounting hole 211. The spinning bracket 220 and the spinning sleeve 210 are connected to each other with the mounting rod 280. The cover body 300 surrounds and is fixed on the mounting rod 280. When the spinning bracket 220 is spinning, the mounting rod 280 and the spinning sleeve 210 are rotated with the spinning bracket 220 to wind the cover body 300 around the spinning bracket 220 and the spinning sleeve 210.

With reference to FIGS. 3 and 6, the spinning mechanism 200 further comprises an outer sleeve 290 surrounding the spinning sleeve 210, the fixed rod 240, and the spinning bracket 220. The outer sleeve 290 has a groove 291 formed in the outer surface thereof. The mounting rod 280 is mounted in the groove 291. When the spinning bracket 220 is spinning, the cover body 300 will wind around the outer sleeve 290 to prevent the cover body 300 from directly winding around the spinning sleeve 210 and the spinning bracket 220 to reduce a spinning transmission.

With reference to FIG. 1, the safety gate 10 further comprises a second post assembly 500 opposite to the first post assembly 100. The second post assembly 500 and the first post assembly 100 are respectively mounted on opposite two sides of the entrance. The cover body 300 has a fixing unit 600 mounted in the right edge thereof. The cover body 300 can be fixed in the second post assembly 500 via the fixing unit 600.

Figure 7:
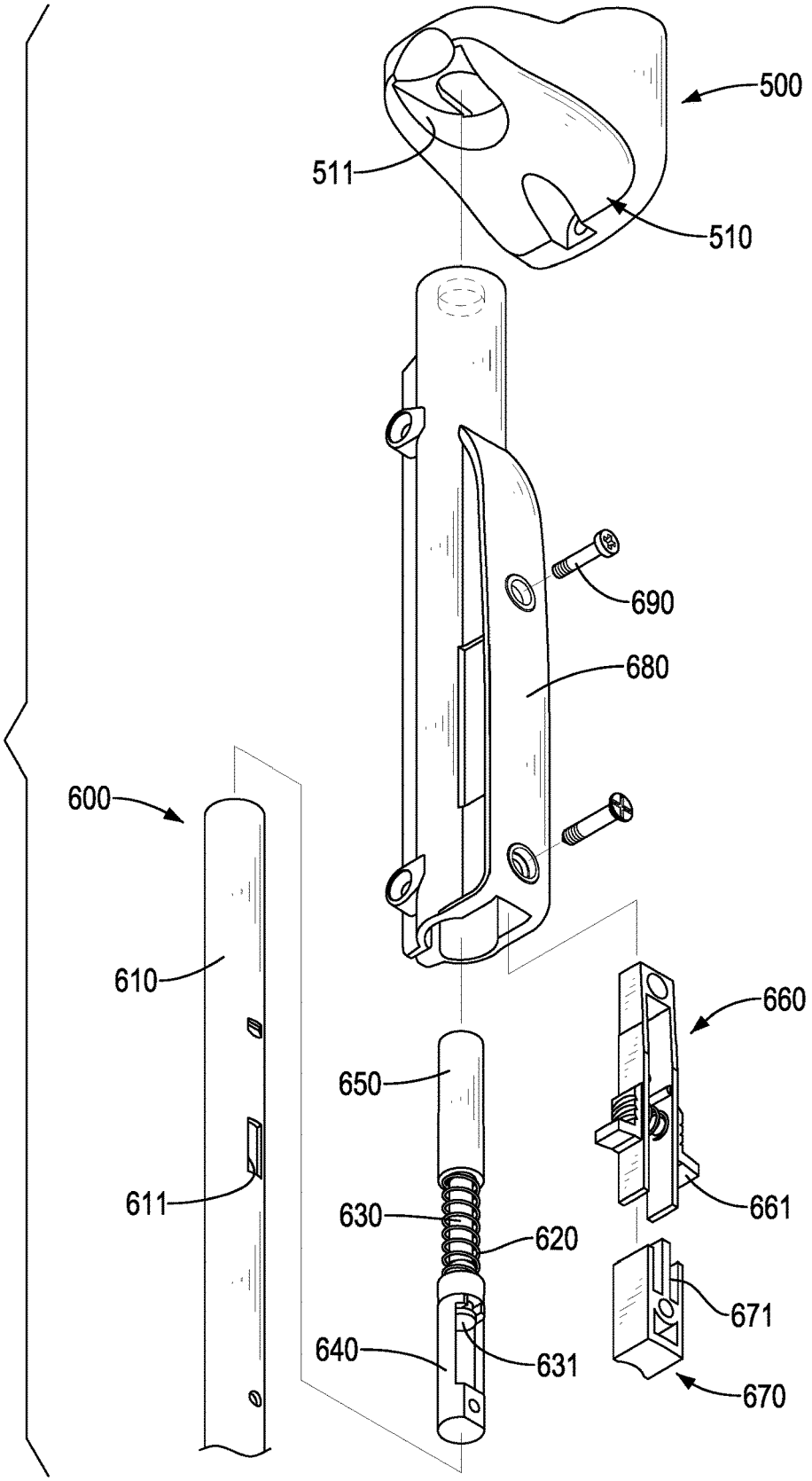
FIG. 7 is an enlarged and exploded perspective view of the safety gate in FIG. 1 showing a fixing unit of the safety gate.

With reference to FIG. 7, the fixing unit 600 has a mounting tube 610, a second resilient element 620, a sliding rod 630, a fitting seat 640, and an end cap 650. The mounting tube 610 is a hollow tube. The second resilient element 620, the sliding rod 630, and the fitting seat 640 are mounted in the mounting tube 610. The cover body 300 is connected with the mounting tube 610. The cover body 300 has a sleeve formed at the right edge thereof. The mounting tube 610 is inserted in the sleeve of the cover body 300.

The sliding rod 630 has two ends, and a flange 631 is formed on one of the ends of the sliding rod 630. The sliding rod 630 is slidably mounted in the fitting seat 640, the flange 631 of the sliding rod 630 abuts against the fitting seat 640, and the other end of the sliding rod 630 protrudes from the fitting seat 640. The end cap 650 is mounted around the end of the sliding rod 630 opposite to the flange 631. The second resilient element 620 is mounted around the sliding rod 630 and is disposed between the end cap 650 and the fitting seat 640.

The second post assembly 500 has an upper second bracket 510 and a lower second bracket 520 arranged vertically at a spaced interval. The upper second bracket 510 has an engagement recess 511. The sliding rod 630 protrudes from the mounting tube 610 to insert the sliding rod 630 and the end cap 650 into the engagement recess 511. To fix the cover body 300 in the second post assembly 500, the end cap 650 is pressed to move down the end cap 650 and the sliding rod 630 relative to the fitting seat 640, and the second resilient element 620 is compressed. After the end cap 650 is positioned lower than the engagement recess 511, the end cap 650 is moved to align with the engagement recess 511, and the second resilient element 620 is restored to push the end cap 650 to move up relative to the mounting tube 610 to mount in the engagement recess 511. Accordingly, the cover body 300 is fixed in the second post assembly 500.

The fixing unit 600 further comprises a switch element 660, a fixing element 670, and a housing 680. The mounting tube 610 has an elongated opening 611. A screw 690 is slidably mounted through the elongated opening 611 to connect the fitting seat 640 and the switch element 660. The switch element 660 is U-shaped and has two handles 661 formed on opposite two sides thereof. A spring is mounted in the switch element 660. The fixing element 670 is fixed on the mounting tube 610 by a screw. The fixing element 670 has slots 671 to engage the switch element 660. The switch element 660 can be compressed by pressing the two handles 661 to engage into the slots 671 of the fixing element 670. The housing 680 covers the switch element 660 and the fixing element 670. The housing 680 has openings for the handles 661 to protrude therefrom. The switch element 660 is compressed and is moved down into the slots 671 of the fixing element 670 to move down the fitting seat 640 relative to the mounting tube 610, and the end cap 650 is moved down to a position lower than the engagement recess 511. After that, the switch element 660 is disengaged from the fixing element 670 and is moved up, and the second resilient element 620 will push the end cap 650 upwardly to be inserted into the engagement recess 511.

What is claimed is:

1. A safety gate comprising:

a first post assembly;

a spinning mechanism rotatably mounted in the first post assembly and having a first abutting portion;

a cover body having two edges, one of the edges mounted in the spinning mechanism, the cover body configured to be selectively wound around the spinning mechanism, and selectively pulled out from the spinning mechanism to spin the spinning mechanism; and a positioning mechanism having a knob having a lug;

a positioning mount connected with the knob, configured to be moved upwardly or downwardly relative to the spinning mechanism to selectively disengage from and engage with the spinning mechanism, and having a sliding groove having a second abutting portion protruding from the sliding groove, wherein the lug is slidably mounted in the sliding groove and selectively abuts against the second abutting portion;

wherein when the positioning mount is engaged with the spinning mechanism to prevent the spinning mechanism from spinning, the lug is located below and abuts against the first abutting portion to prevent the positioning mechanism from moving up relative to the spinning mechanism; and when the lug is slid to misalign with the first abutting portion and abut against the second abutting portion, the positioning mount is capable of moving up relative to the spinning mechanism to disengage from the spinning mechanism; wherein the positioning mechanism has a turning member and a fastener;

the knob has an engaging recess formed in the knob;

the lug is formed on the turning member and is engaged with the engaging recess of the knob to connect the knob with the turning member;

the positioning mount is mounted around an end of the knob and is connected with the knob by the fastener of the positioning mechanism;

the positioning mechanism has a torsion spring mounted in the positioning mount at a side of the positioning mount that faces the knob;

the knob has a spring-abutting portion disposed near and abutting against an end of the torsion spring;

the torsion spring is twisted when the lug is sliding to abut against the second abutting portion; and after the positioning mount is disengaged from the spinning mechanism, the torsion spring pushes the spring-abutting portion relative to the positioning mount to drive the lug to slide relative to the sliding groove to align with the first abutting portion;

the lug has a beveled surface formed in a bottom of the lug;

after the positioning mount is disengaged from the spinning mechanism, the torsion spring pushes the spring-abutting portion to drive the lug to slide to align with the first abutting portion; and when the lug is located above the first abutting portion, the knob is pressed to slide the beveled surface along the first abutting portion to move down the lug to a position below the first abutting portion.

2. The safety gate as claimed in claim 1, wherein:

the positioning mount has two limiting portions arranged at a spaced interval;

the knob has a positioning protrusion located between the two limiting portions, wherein when the knob is turned relative to the positioning mount to abut the positioning protrusion against the two limiting portions, the lug is slid to align with the first abutting portion and the second abutting portion.

3. The safety gate as claimed in claim 1, wherein the spinning mechanism comprises a spinning sleeve, a spinning bracket, a first resilient element, and a fixed rod;

the spinning bracket is rotatably mounted on the first post assembly;

the fixed rod is fixed in the first post assembly;

the spinning bracket is connected to the fixed rod by the first resilient element; and the spinning bracket is rotated relative to the fixed rod to twist the first resilient element to store elastic potential energy.

4. The safety gate as claimed in claim 3, wherein the spinning mechanism comprises a fixed sleeve fixed on the first post assembly, mounted around the spinning bracket, and securely connected to the fixed rod;

the spinning bracket has first engagement teeth formed on an outer surface of the spinning bracket;

the fixed sleeve has second engagement teeth formed on an inner surface of the fixed sleeve; and the positioning mount is mounted between the fixed sleeve and the spinning bracket and has third engagement teeth engaged with the first engagement teeth and the second engagement teeth.

5. The safety gate as claimed in claim 4, wherein the spinning mechanism comprises a mounting rod having two ends respectively mounted in the spinning bracket and the spinning sleeve; and the cover body surrounds and is fixed on the mounting rod.

6. The safety gate as claimed in claim 1, wherein the safety gate comprises a second post assembly opposite to the first post assembly; and the cover body has a fixing unit mounted in the other one of the two edges of the cover body for fixing the cover body in the second post assembly.

7. The safety gate as claimed in claim 6, wherein the fixing unit has a mounting tube, a second resilient element, a sliding rod, and a fitting seat;

the second resilient element, the sliding rod, and the fitting seat are mounted in the mounting tube;

the sliding rod is slidably mounted in the fitting seat and has an end protruding from the fitting seat and a flange abutting against the fitting seat;

the cover body is connected with the mounting tube; and the second post assembly has an engagement recess formed in the second post assembly; wherein the sliding rod selectively protrudes from the mounting tube to insert into the engagement recess of the second post assembly.

* * * * *